US007198540B2

(12) United States Patent
Liu

(10) Patent No.: US 7,198,540 B2
(45) **Date of Patent: *Apr. 3, 2007**

(54) BRA CONSTRUCTION

(75) Inventor: Zhen Qiang Liu, Shenzhen (CN)

(73) Assignee: Regina Miracle International Limited, Hong Kong (HK)

( * ) Notice: Subject to any disclaimer, the term of this patent is extended or adjusted under 35 U.S.C. 154(b) by 385 days.

This patent is subject to a terminal disclaimer.

(21) Appl. No.: 10/733,179

(22) Filed: Dec. 10, 2003

(65) Prior Publication Data

US 2006/0141905 A1 Jun. 29, 2006

(51) Int. Cl.
*A41C 3/10* (2006.01)
*A41C 3/00* (2006.01)

(52) U.S. Cl. ..... 450/39; 450/92; 450/93

(58) Field of Classification Search ..... 450/37–57, 450/92, 93; 2/267, 268; 623/7, 8; 156/77–79, 156/242, 246; 264/464, 466
See application file for complete search history.

(56) References Cited

U.S. PATENT DOCUMENTS 2,664,571 A * 1/1954 Kempel ..... 450/57
2,834,352 A * 5/1958 Murry ..... 450/57
2,867,818 A * 1/1959 Creamer ..... 623/7
2,896,631 A * 7/1959 Block ..... 450/51
3,620,222 A * 11/1971 Block ..... 450/57
4,008,029 A * 2/1977 Shokite ..... 425/157
4,080,416 A * 3/1978 Howard ..... 264/258
4,202,853 A * 5/1980 DiTullio ..... 264/138
4,250,137 A * 2/1981 Riedler ..... 264/554
6,042,608 A * 3/2000 Ishikawa et al. ..... 623/7
6,796,876 B2 * 9/2004 Luk ..... 450/39
6,878,033 B2 * 4/2005 Luk ..... 450/39
6,881,123 B1 * 4/2005 Klakauskas ..... 450/39

* cited by examiner

*Primary Examiner*—Gloria M. Hale
(74) *Attorney, Agent, or Firm*—Ostrolenk, Faber, Gerb & Soffen, LLP

(57) ABSTRACT

A breast cup construction of a cup shape to be incorporated as part of a brassiere, the breast cup construction comprising a molded to a cup shape laminated core assembly comprising a ply of foam material and a ply of fabric material disposed to the convex side of the foam material. An exterior ply is overlying and to the concave and convex sides of at least part of the laminated core assembly. The exterior ply is folded at and to define at least part of the neckline perimeter of the cup shape.

34 Claims, 8 Drawing Sheets

BRA CONSTRUCTION

FIELD OF THE INVENTION

The present invention relates to an improved bra construction and in particular to a bra construction which includes a molded cup form utilizing moldable materials.

BACKGROUND

For some people it is important that a bra is of a kind which is as inconspicuous as possible. Modest and conservative people still treat a bra as a traditional form of undergarment, parts of which should not be visible when worn underneath overgarments. Accordingly in bra constructions and to meet such desires, bra assemblies and construction techniques need to be considered which achieve such needs. An inconspicuous bra cup construction may not just need to address the pattern of panels defining the cup construction but may also need to pay attention to the perimeter construction of element of the overall bra. The importance of the construction around the top or neckline region of the breast cups of a bra is important as it is this region of the bra which may on occasion become exposed to the exterior of the garment either through shadowing through the material of the overgarment or through a gap of the overgarment and the wearers body.

Molded breast cup constructions are becoming more prevalent and can eliminate the need for stitching across the breast cup which previously was required to define the three dimensional cup shape formed from at least two panels sewn together across the breast cup configuration. Molded breast cups have eliminated the need for stitching across the breast cup, however stitching may still be provided to provide a trim to the neckline and indeed to the entire perimeter of the breast cup construction as incorporated with the other components to define the bra.

Accordingly it is an object of the present invention to provide a bra with a breast cup construction which provides a reduced conspicuous neckline.

It is a further object of the present invention to provide a breast cup construction which has no stitching provided along at least a substantial part of the neckline of the breast cup.

BRIEF DESCRIPTION OF THE INVENTION

In a first aspect the present invention consists in a breast cup construction of a cup shape to be incorporated as part of a brassiere, said breast cup construction comprising:

a molded to a cup shape laminated core assembly comprising a ply of foam material and a ply of fabric material disposed to the convex side of said foam material an exterior ply overlying and to the concave and convex sides of at least part of said laminated core assembly, said exterior ply folded at and to define at least part of the neckline perimeter of said cup shape.

Preferably said exterior ply is folded at and along to define the entire neckline perimeter of said cup shape.

Preferably said ply of foam material and said ply of fabric material are coextensive.

Preferably said ply of foam material and said ply of fabric material are coextensive, said ply of foam material being of a reduced thickness at the neckline perimeter disposed perimeter thereof.

Preferably said ply of foam material and said ply of fabric material are coextensive, said ply of foam material being of a reduced thickness at the neckline perimeter disposed perimeter thereof and wherein the transition towards said reduced thickness is gradual.

Preferably said transition is a taper and wherein the thinnest part of said foam ply is at said neck line perimeter of said cup shape.

Preferably said transition is at region of said foam ply extending from said neck line perimeter disposed perimeter thereof to less than one third the diametric width across said cup shape.

Preferably said ply of foam material and said ply of fabric material are coextensive save for at a region extending inwardly from the neckline perimeter disposed perimeter of said core laminate assembly where said core laminated assembly is absent of said ply of foam material.

Preferably said region extending inwardly is less than one third the diametrical width of said cup shape.

Preferably said exterior ply is laminated to the concave side of said core assembly.

Preferably said exterior ply is laminated to the convex side of said core assembly.

Preferably said exterior ply is laminated to the concave side and the convex side of said core assembly.

Preferably said exterior ply is not sewn to said core assembly at said neckline.

Preferably said exterior ply is folded only about said core assembly at said neckline.

Preferably said exterior ply is sewn to said core assembly at the base line perimeter of said cup shape.

Preferably said exterior ply is coextensive with said core assembly to said concave side thereof.

Preferably said exterior ply is coextensive with said core assembly to said convex side thereof.

Preferably said exterior ply is coextensive with said core assembly to said concave side and said convex side thereof.

Preferably said exterior ply is a fabric material.

Preferably said neckline is curved when viewed in frontal direction.

Preferably said core assembly includes a ply of reinforcing material disposed to the concave side of said core assembly and is provided at the to be upwardly supportive region of said cup shape.

Preferably said reinforcing material is a panel of fabric material.

Preferably said panel of fabric material is laminated to the concave side of said foam ply.

Preferably said panel of fabric material is laminated to said foam material.

Preferably said exterior ply is creased defining the fold thereof.

In a second aspect the present invention consists in a breast cup of a cup shape to be incorporated as part of a brassiere, said breast cup comprising:

a molded to a cup shape laminated core assembly comprising a ply of foam material and a ply of fabric material disposed to the concave side of said foam material an exterior ply overlying and to the concave and convex sides of at least part of said laminated core assembly, said exterior ply folded at and to define the neckline perimeter of said cup shape.

In a further aspect the present invention consists in a breast cup construction of a cup shape to be incorporated as part of a brassiere, said breast cup construction comprising:

a molded to a cup shape laminated core assembly comprising a ply of foam material and a ply of fabric material disposed to the convex side of said foam material an exterior ply overlying and to the concave and convex sides of at least part of said laminated core assembly, said exterior ply enveloping the core assembly at at least those regions of said laminated core assembly disposed to the neckline side of said cup shape.

In a further aspect the present invention consists in a method of forming a breast cup construction comprising (a) placing a molded to a cup shape laminated core assembly comprising a ply of foam material and a ply of fabric material disposed to the convex side of said foam material onto a ply of fabric material which has molded therein two cup shaped reliefs which are juxtaposed and abut each other along a junction line, in a manner to position said core assembly onto one of said cup shaped reliefs and wherein the neckline to be disposed perimeter of said core assembly is positioned adjacent said junction line, (b) affixing said core assembly with said ply of fabric material, (c) folding said ply of fabric material about said junction line to bring the other of said cup shape reliefs in overlying relation with said core assembly to the other side of said core assembly as affixed in step (b) and (d) affixing the second cup shaped relief with one or both of said core assembly and said first cups shaped reliefs.

Preferably said neckline to be disposed perimeter of said core assembly is positioned adjacent said junction line, Preferably said affixing the second cup shaped relief with one or both of said core assembly and said first cups shaped reliefs is by laminating.

Preferably said affixing said core assembly with said ply of fabric material a laminating affixing.

Preferably said cup shape laminated core assembly is formed from a perform panel laminated core assembly of a ply of foam material and a ply of fabric material.

Preferably said ply of foam material is tapered towards an edge of said panel.

Preferably said cup shape is molded into said perform by a molding press, the positioning of the region of taper of said panel being placed relative to said molding press such that said cups shape is generated therein with said taper disposed at the neckline to be disposed region of said cup shape.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

BRIEF DESCRIPTION OF THE DRAWINGS

A preferred form of the present invention will now be described with reference to the accompanying drawings in which.

DETAILED DESCRIPTION OF THE INVENTION

Figure 1:
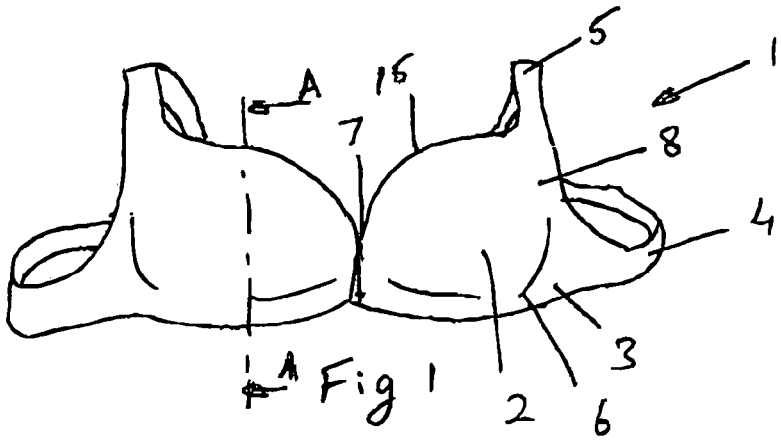
FIG. 1 illustrates a bra incorporating a breast cup construction (x2) of the present invention.

With reference to FIG. 1 there is shown a bra 1 which incorporates a breast cup construction 2 which is supported by a lower perimeter support 3, torso straps 4, and optionally shoulder straps 5. The breast cup construction defines a three dimensional cup form and may be of a particular size and/or shape as desired. The breast cup construction includes a neckline 15 a base region 6 a central region 7 and an outer perimeter region 8. A breast cup 2 formed according to the present invention may be incorporated with the other components of the bra by the sewing of the lower perimeter support 3 to the breast cup 2 and the engagement of the shoulder straps 5 to upper portions of the breast cup 2. The neckline 15 of the breast cup remains a free edge and preferably extends between the central region 7 of the breast cup 2 at where the breast cup construction 2 engages to the other of the breast cups of the bra and the shoulder strap attachment region where the shoulder straps 5 engage with the breast cup 2 or the perimeter 3.

Figure 2:
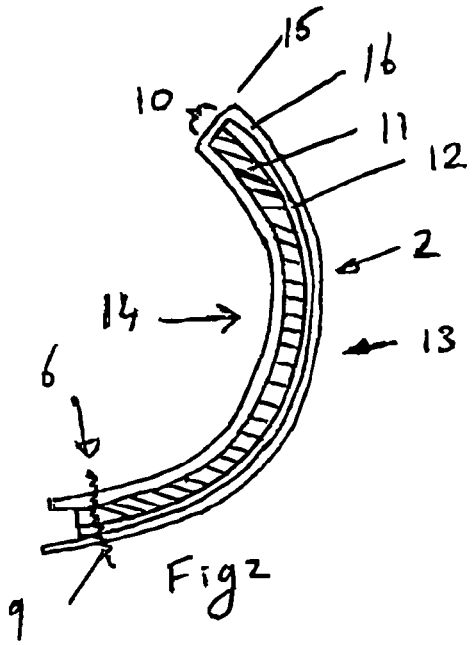
FIG. 2 is a sectional view through section AA of FIG. 1.

The breast cup 2 of the present invention is of a molded breast cup construction and as a consequence allows for the breast cup to be formed without the need or by reducing the need for stitching to finish. Accordingly a substantial part if not all of the parts of the breast cup 2 are made from moldable materials. With reference to FIG. 2, there is shown a sectional view of a breast cup 2 through for example section AA of FIG. 1. At the neckline 15 of the breast cup 2 there is shown a free edge of the breast cup 2 and at the lower perimeter region 6 there is shown stitching 9 which may for example be the stitching provided to affix the breast cup to the lower perimeter support 3.

The breast cup construction preferably includes a core assembly 10 which consists of at least a ply of foam material 11 such as for example stretched foam. This foam material may be of a thickness of approximately 6 mm. Affixed by lamination (e.g. by heat welding and/or adhesive affixing) to the foam ply 11 is a fabric ply 12. This fabric ply may contain for example 90% polyster and 10% spandex. The fabric material is significantly thinner than the foam material and provides a supporting substrate to ensure the maintenance of the integrity of the foam layer prior to and during the forming steps and also to provide a separation between the foam layer and that portion of the molding machine (reference to which will be made hereinafter) to mold a cup form into the core assembly 10 of the breast cup 2. The foam ply 11 is preferably directly laminated to the fabric ply 12 however in some configurations an intermediate ply may exist between the foam ply 11 and the fabric ply 12. Furthermore additional plies may be provided to the preferred form of the core assembly 10 as just described and a second fabric layer (not shown) may be provided to the opposite side of the foam ply to which the fabric ply 12 is provided.

Figure 4:
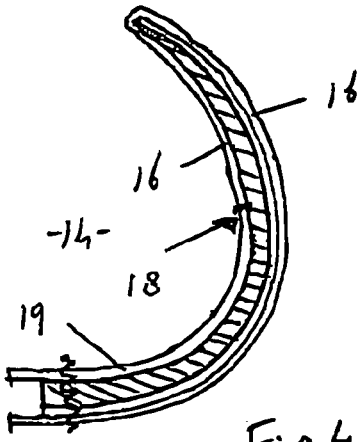
FIG. 4 illustrates a further alternative breast cup construction through section AA of FIG. 1.

The breast cup 2 has a convex side 13 and a concave side 14. Provided to both the concave and convex side and extending continuously about and at least in part along the neckline 15 extending between the central region 7 and the opposite end of the neckline 15 at or proximate to which the shoulder strap 5 is affixed, there is provided an exterior ply or assembly of plies of exterior covering ply 16 of preferably a fabric material (containing for example 72% nylon and 28% LYCRA spandex). In the most preferred form and when viewed in frontal direction, the exterior covering ply 16 extends along the entire neckline 15 of the assembly. The exterior covering ply 16 is folded at the neckline region 15 about and to define the neckline 15 of the breast cup 2. In the most preferred form the exterior covering ply 16 envelopes the entire core assembly 10 of the breast cup 2. Indeed in the most preferred form the exterior covering ply 16 is of a single sheet of fabric material however in alternative configurations, the exterior covering ply 16 is also engaged to another fabric material which provides an extension to the portion of the exterior covering ply 16 which does extend and fold about the neckline 15 of the breast cup 2. As for example shown in FIG. 4, the exterior covering ply 16 terminates on the concave side 14 at a seam 18 at which it is engaged to a further ply such as a fabric ply 19. Effectively the exterior covering ply 16 and the ply 19 do provide coverage to envelope the core assembly 10. However and in yet further configurations, the core assembly 10 may not be entirely enveloped by a or the exterior covering ply 16. However the exterior covering ply 16 does extend and fold about and to define the neckline 15. The core assembly may include additional plies positioned intermediate of the foam ply 11 and the exterior covering ply 16.

Figure 20:
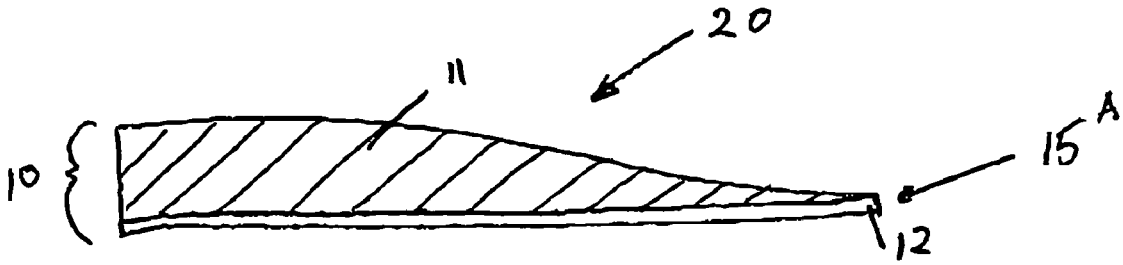
FIG. 20 is a close up sectional view of the core assembly with the foam removed region tapering towards the neckline of the core assembly to be positioned at or proximate to the neckline of the final breast cup construction.
Figure 21:
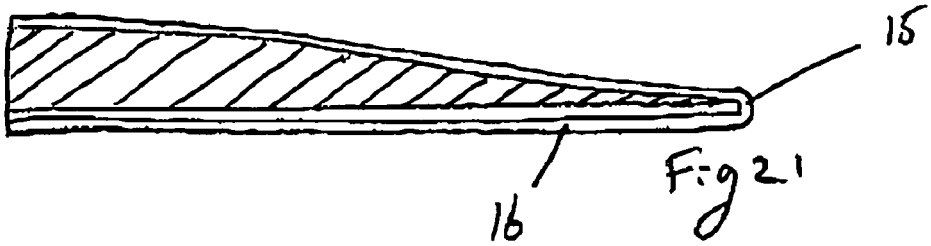
FIG. 21 illustrates the core assembly of FIG. 20 and wherein the fabric exterior has been folded thereabout.
Figure 22:
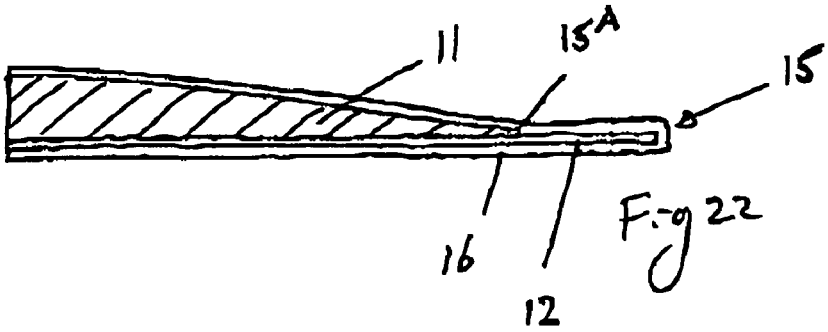
FIG. 22 is an alternative configuration and wherein the foam terminates short of the neckline of the breast cup construction yet the fabric substrate to the foam layer does reach the neckline portion of the cup assembly (although this is also optional)

With the provision of a fold defining the neckline 15 of the breast cup 2 and provided by the exterior covering ply 16, no stitching is necessary at the neckline of the breast cup 2 and hence of the bra assembly. By folding about the neckline disposed edge of the core assembly 10, the covering ply 16 provides a trim without the need for stitching to be provided to the breast cup 2. In order to enhance the degree of unobtrusiveness of the neckline of the breast cup construction a further enhancement may be provided by the provision of a taper or tapered region 20 of the breast cup core assembly 10 as shown in FIG. 20. The neckline disposed edge $\mathbf{15}^{A}$ of the core assembly 10 may consist solely of the fabric ply 12. Extending from the neckline disposed edge $\mathbf{15}^{A}$ of the core assembly 10 is the foam ply 11 which tapers to a full thickness over a distance which allows for the taper to be gradual enough to not be noticeable to the exterior of the breast cup 2. The tapered region 20 of the foam ply 11 tapers to a point at the neckline disposed edge $\mathbf{15}^{A}$ of the core assembly and with reference to FIG. 21, is positioned at the neckline 15 of the cup 2 when the covering fabric ply 16 is engaged and folded about the neckline 15. In an alternative configuration the foam ply 11 may not extend all the way to the neckline 15 and the fold of the covering fabric ply 16 may be provided a distance away from the neckline disposed end $\mathbf{15}^{A}$ of the foam ply 11. In the configuration of FIG. 22, the core fabric ply 12 does extend to the neckline 15 however this may also be optional and the core fabric ply 12 may terminate at the same point as the foam ply 11 at its neckline disposed edge $\mathbf{15}^{A}$ which is not at the neckline 15.

Figure 3:
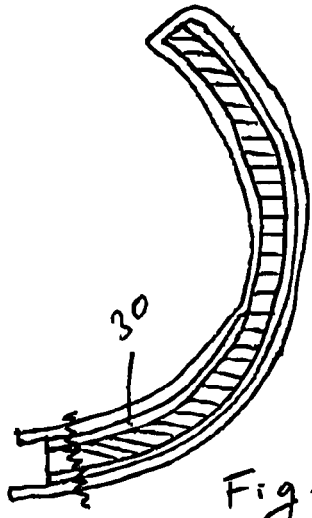
FIG. 3 illustrates an alternative breast cup construction through section AA of FIG. 1.

In the most preferred form and as a consequence of the manufacturing steps which will hereinafter be described, the fabric ply 12 of the core assembly 10 is disposed to the convex side of the core assembly 10. The foam ply 11 is disposed to the concave side of the core assembly 10. With reference to FIG. 3, an additional reinforcing panel 30 may be incorporated with the core assembly 10. The reinforcing pad or panel 30 may be of a fabric or non-woven synthetic material and may for example contain 82% nylon and 18% LYCRA spandex. It is preferably disposed to the lower portions of the breast cup 2 as for example shown in FIG. 3. The reinforcing panel 30 is provided towards the lower portion of the breast cup 2 as this is where the greatest pressure as a result of the weight of the breast is supported by the breast cup 2. Accordingly such additional reinforcing will ensure that the integrity of the shape of the breast cup 2 may be maintained or is encouraged to be maintained. The panel 30 is preferably laminated to the foam panel 11. Such lamination may be by a heat welding or by an adhesive or in part by both. The reinforcing panel 30 may be of a single ply material or of a multi-ply assembly.

The exterior covering ply 16 preferably also lies over the reinforcing panel 30 thereby capturing the reinforcing panel 30 between the exterior covering ply 16 and the foam ply 11.

In one form the foam ply 11 is not tapered as for example shown in FIGS. 2 and 3. The tapered configuration as for example shown in FIG. 4 or in part shown in FIG. 21 or 22 allows for the breast cup 2 to be of a thin walled construction at the neckline 15. The provision of the thin walled construction of the breast cup 2 at the neckline 15 further reduces the obtrusiveness of the breast cup 2 at the neckline and virtually feathers the breast cup at the neckline with and against the skin of the wearer of the bra.

Accordingly the fold of the exterior covering ply 16 to define the edge of the neckline of the breast cup 2 can be provided without the need for stitching at that region. Whether or not the foam ply is tapered, the absence of stitching will allow for the neckline to remain very plain and uncomplicated and thereby reduce the obtrusiveness of the neckline of the breast cup 2.

Figure 5:
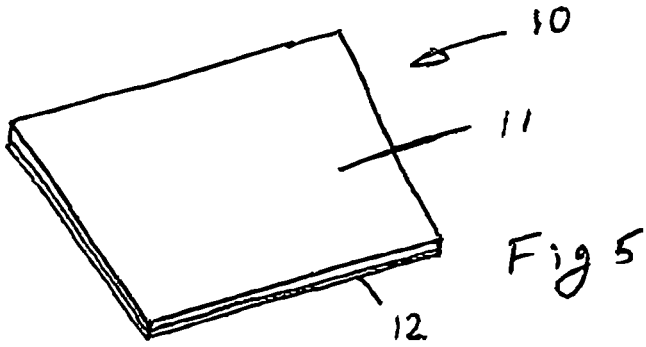
FIG. 5 illustrates a core assembly of plies of material to form the core of the breast cup construction.

A preferred method of manufacture of the present invention will now be described with reference to FIGS. 5 to 19. FIG. 5 shows a pre-form construction of the core assembly consisting of a planar foam ply 11 and the fabric ply 12. The pre-form as shown in FIG. 5 is of a rectangular or square shape and of a sufficient size to allow for the introduction by molding, of a cup form therein. For the configuration of the breast cup construction where the foam is tapered at the regions towards the neckline 15, a region 40 of the foam adjacent one edge 41 of the pre-form may be removed. Such removal may be to provide a gradual taper of the foam from the major region 42 of the foam ply to a thin or pointed edge at the perimeter 41 of the ply. Whilst in the preferred form the taper is towards the perimeter 41 it may be that the taper is provided to terminate inward from such edge 41 of the pre-form of the core assembly 10.

Figure 7:
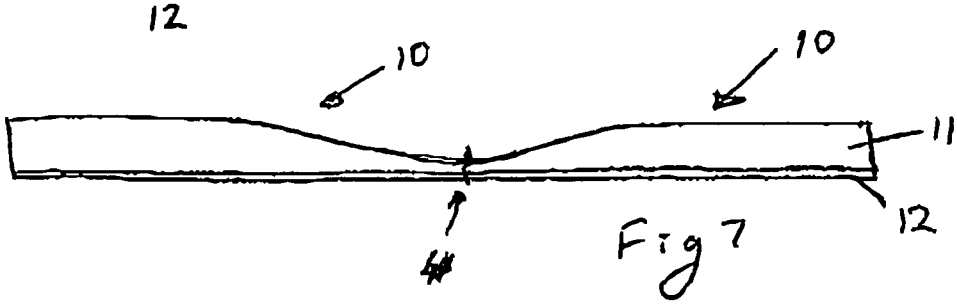
FIG. 7 is a side view in direction B of FIG. 6 but wherein in addition, a second assembly of core plies has been sewn to a first assembly and wherein part of the foam ply has been removed of each of the assemblies.
Figure 8:
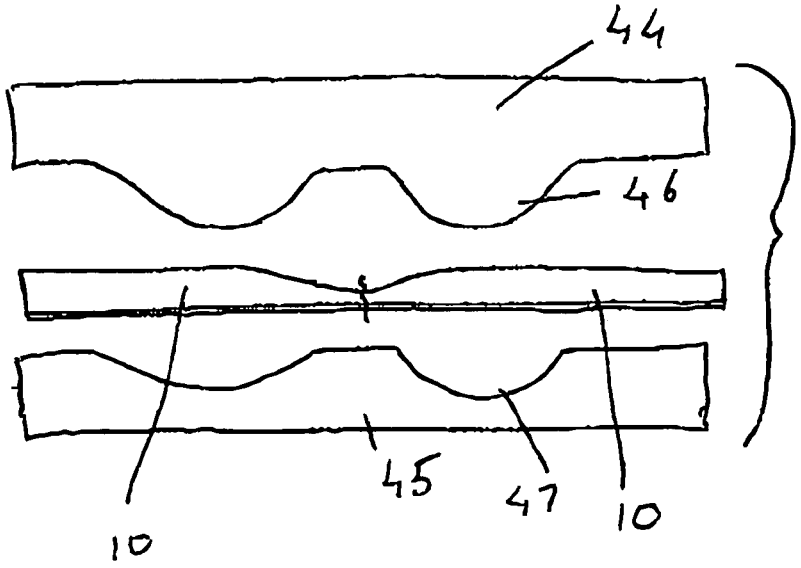
FIG. 8 is a sectional view through a molding machine showing the FIG. 7 positioned intermediate of the upper and lower molds prior to the molding thereof to form the cup forms into the core assembly.

In the method where a molding device as shown in FIG. 8 is provided which simultaneously molds two cup forms, the pre-form of the core assembly 10 may be affixed to a like pre-form by the sewing along the edge 41 of the respective core assemblies 10 as shown in FIG. 7.

With reference to FIG. 8, the core assembly 10 is moved to a molding device which includes an upper mold 44 and a lower mold 45 which include relief features 46, 47 (preferably x2) which are of a three dimensional cup form of an approximate shape of the desired breast cup shape to be assumed by the breast cup 2. The upper and lower molds 44, 45 are able to move towards and away from each other. In a condition moved towards each other they will subject the pre-form of the core assembly 10 to a deformation. Preferably the upper and lower molds are heated sufficient to affect the resilience of the core assembly such that when the mold is released after the molding step, a three dimensional cup form remains in each of the pre-forms of the core assembly 10. During this molding step the upper mold may be of a temperature of approximately 200 degrees Celsius and the lower mold may be of a temperature of approximately 195 degrees Celsius. The dwell time of the molding holding the molds in the closed condition would be in the order of 90 seconds.

Figure 9:
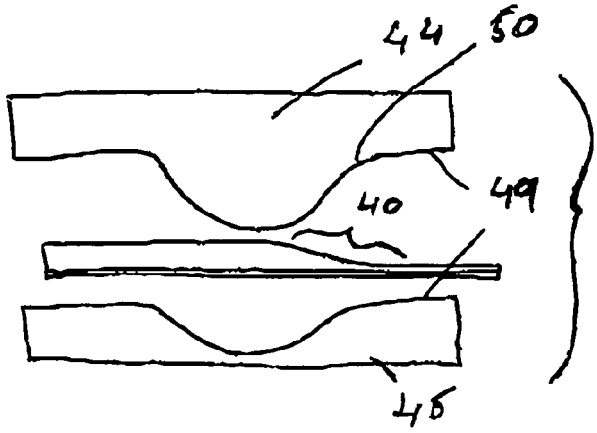
FIG. 9 is a sectional view through a single cup molding machine but analogous to that of FIG. 8.

In an alternative form of a molding device as for example shown in FIG. 9, the molding device may only include a single cup form relief feature in each of the upper and lower molds 44, 45. As can be seen with reference to FIGS. 8 and 9, the tapered region 40 is provided to be positioned between the two mold portions such that the taper initiates within the relief portion and extends beyond the relief portion to the parallel planar surfaces 49 exterior of the cup form relief of the mold.

As a consequence the cup form molded in the pre-form core assembly has the tapered region positioned extending inwardly from the neckline of the cup form which is defined by the region 50 of the upper mold 44 and likewise for a corresponding region of the lower mold 45.

Figure 6:
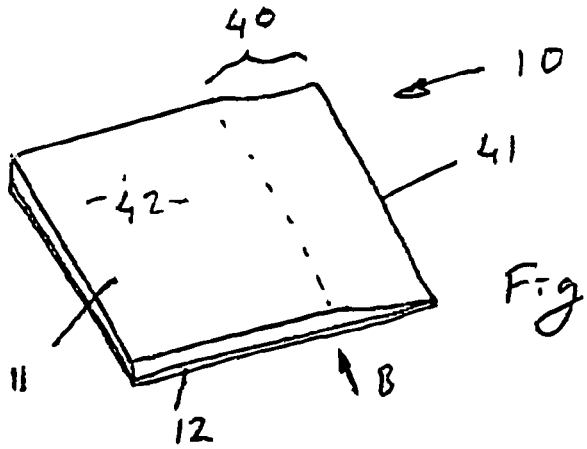
FIG. 6 is a view of the assembly of FIG. 5 but wherein a portion of the foam ply of the assembly has been removed.
Figure 10:
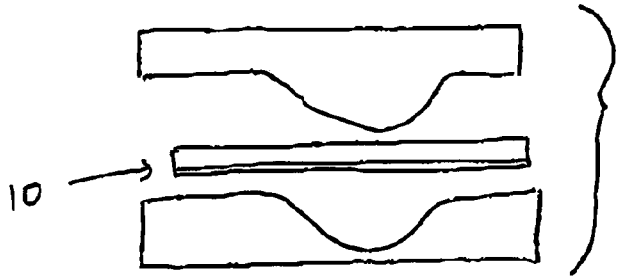
FIG. 10 is a sectional view through a molding machine but showing a core assembly in position ready for molding but wherein in this alternative form, no portion of the foam has been removed.

With reference to FIG. 10, there is shown an alternative of the method of the present invention and wherein no removal of foam to provide a tapered or reducing thickness region is provided in the foam ply of the core assembly 10. In this alternative configuration and which would generate for example a breast cup construction shown in cross-section in FIGS. 2 and 3, the step of removing the foam to define a pre-form as shown in FIG. 6 is absent.

Figure 11:
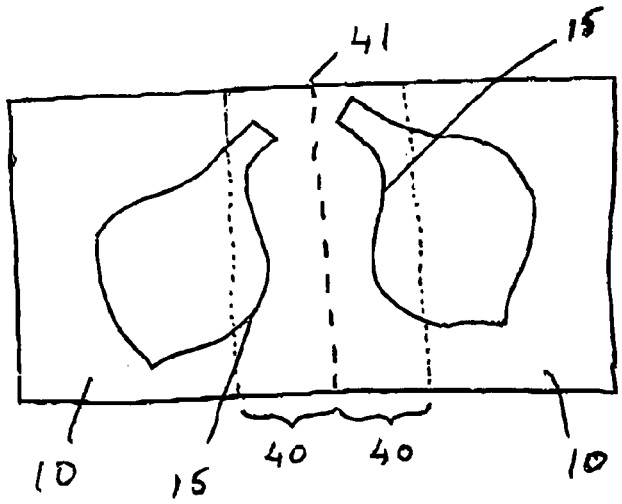
FIG. 11 is a plan view of the core assembly of FIG. 7 after the molding of the breast cup forms into the core assembly.

With reference to FIG. 11 there is shown a plan view of the sewn together pre-form core assemblies 10 of the present invention having been subjected to forming by the molding device of FIG. 8. As can be seen the relief of the upper and lower molds provide the neckline 15 of the cup forms molded in the pre-form at the region of reduced thickness of the foam of the core assembly.

Figure 11A:
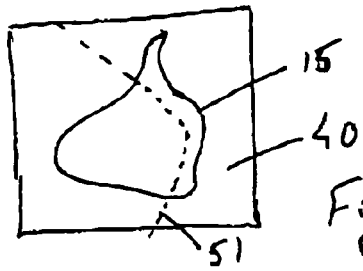
FIG. 11A illustrates a plan view of a molded cup formed in the pre-form of the core assembly and wherein a curved line of initiation of reduced thickness of the foam ply is shown.

The appropriate alignment of the pre-form with the mold can allow for such alignment to be achieved. Whilst in the most preferred form it is the entire neckline edge of the molded cup form which is of a reduced thickness, it may only be the upper or most prominent regions of the neckline 15 at where the region of reduced thickness of the foam ply is provided. With reference to FIGS. 6 and 11, it can be seen that the region of reduced thickness 40 is initiated from the main panel region 42 along a straight line. The straight line provision of the initiation of the reduction in thickness of the foam is convenient to achieve by machine or tool assistance. However it may be that a profiled line of initiation of reduced thickness of the foam may be provided which may be proximate to and to be parallel with the to be neckline of the breast cup 2. Such is for example shown in FIG. 11A. In FIG. 11A the line of initiation 51 runs parallel with at least a substantial part of the neckline 15. However the molding apparatus may be reversed through 180 degrees and the concave defining side of the mold portion may instead be the upper mold portion.

Figure 12:
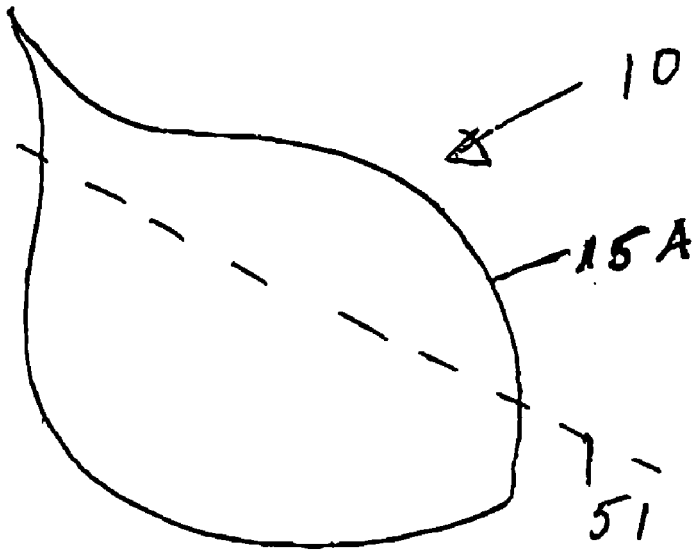
FIG. 12 illustrates the removed breast cup form separated from the peripheral material of the molded core assembly of FIG. 11.
Figure 13:
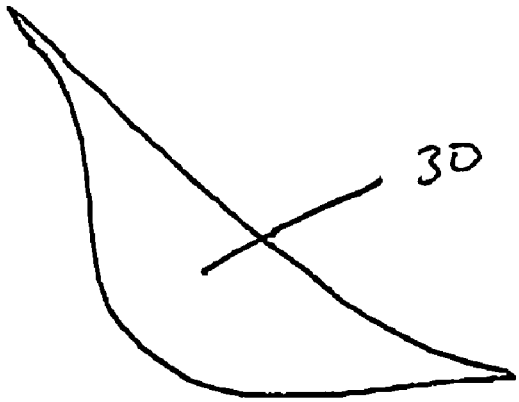
FIG. 13 illustrates a plan view of a reinforcing ply or assembly of plies for incorporation with the molded cup form core assembly of FIG. 12.
Figure 14:
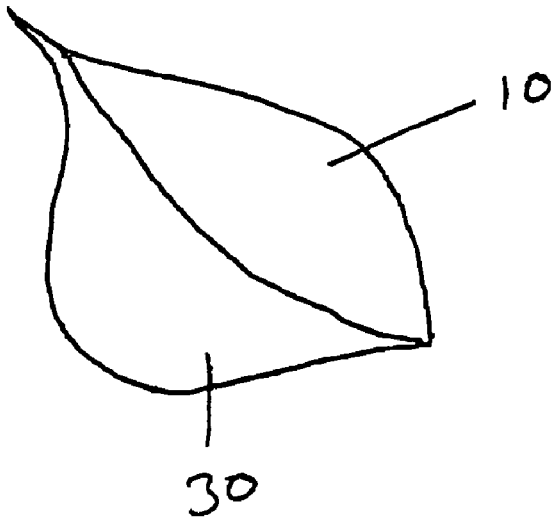
FIG. 14 illustrates the reinforcing ply or assembly of plies of FIG. 13 engaged with the molded cup form core assembly of FIG. 12.

The molds may be of 200° C. and 195° C. and a dwell time of approximately 90 seconds may be utilized to the apply the molding force and heat to the core assembly. Once the cup form has been molded into the pre-form of the core assembly the cup form may be cut from the perimeter of the pre-form to thereby define a cup shape as for example shown in FIG. 12. With reference to FIG. 12, there is shown the perimeter of the cup form. This configuration is of a kind where the foam panel is tapered and the line of initiation of taper is also shown. Prior to removal of the cup forms from the molded pre-form or subsequent thereto, the concave sides of the cups are sprayed with an adhesive. The adhesive is sprayed on at this point in time and allowed to dry for, say, 5 to 6 hours to avoid affixing when the cups are being placed onto the exterior covering ply 16 as hereinafter described, before heat is being applied by way of the molding devices at which time the adhesive will be melted to enable affixing. The application of the adhesive to the concave side of the cup form is to allow for this to be engaged to the exterior covering ply 16 to which reference will hereinafter be made.

Where a configuration as, for example, shown in FIG. 3 is desired, and where a reinforcing panel 30 is to be included, such a reinforcing panel as, for example, shown in FIG. 13 can be affixed to the concave side of the core assembly 10. Such an assembled configuration is for example, shown in FIG. 14.

In the preferred form both sides of the reinforcing panel 30 are sprayed with an adhesive such as that which has been applied to the core assembly cup form and allowed to dry for between 5 to 6 hours. With the application of an adhesive to the various components of the assembly as herein described, and with the suitable application of heat which preferably comes by way of the molding devices during the lamination steps of the invention, the activation of the adhesive occurs for the purposes of achieving the laminated affixing of the components.

Figure 15:
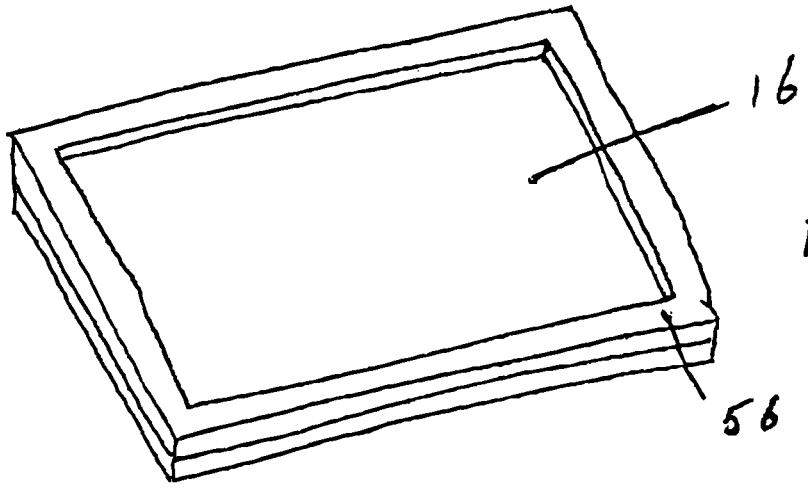
FIG. 15 illustrates a ply of material to cover the exterior in a preformed sheet condition and engaged with a perimeter frame support element to hold (by clamping) the fabric material in position prior to and during the molding of a form into the fabric material held by the rigid frame.
Figure 16:
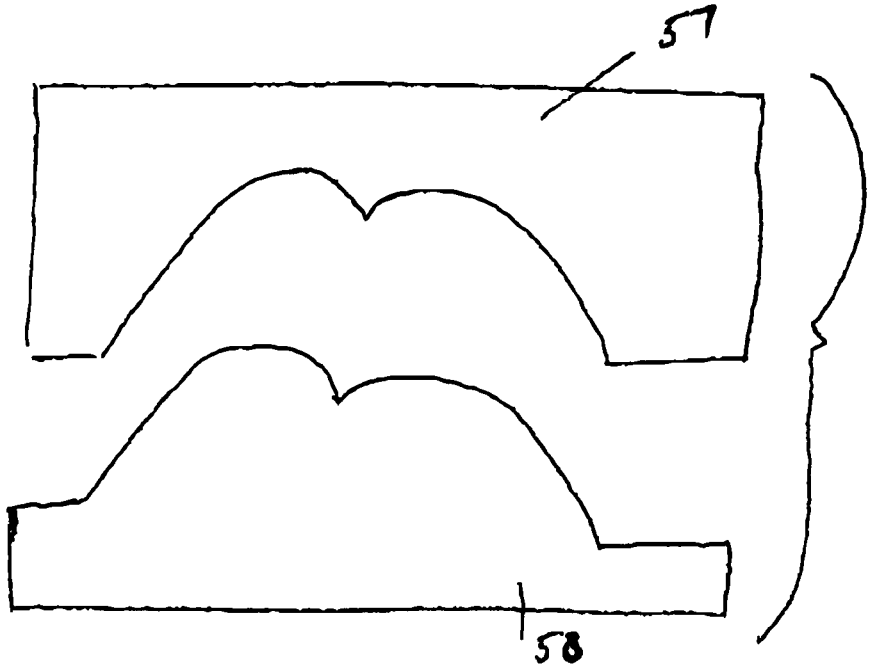
FIG. 16 is a sectional view through an exterior covering ply molding device with which the fabric held by the frame as shown in FIG. 15 can engage and thereby be molded with, FIG. 17 is a sectional view through the molded covering ply after having been molded by the molding device of FIG. 16.
Figure 17:
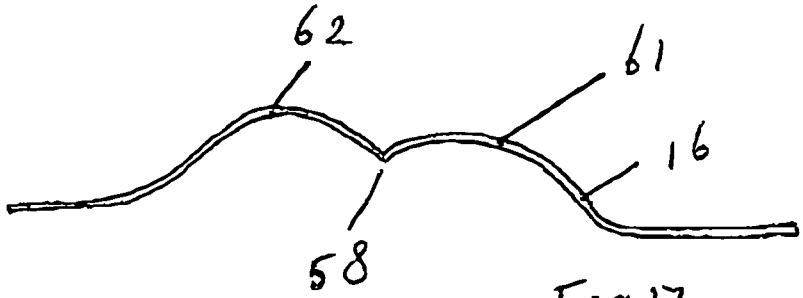
FIG. 17*a* is a plan view of the covering ply, molded after the molding step utilizing the molding device of FIG. 16.
Figure 17A:
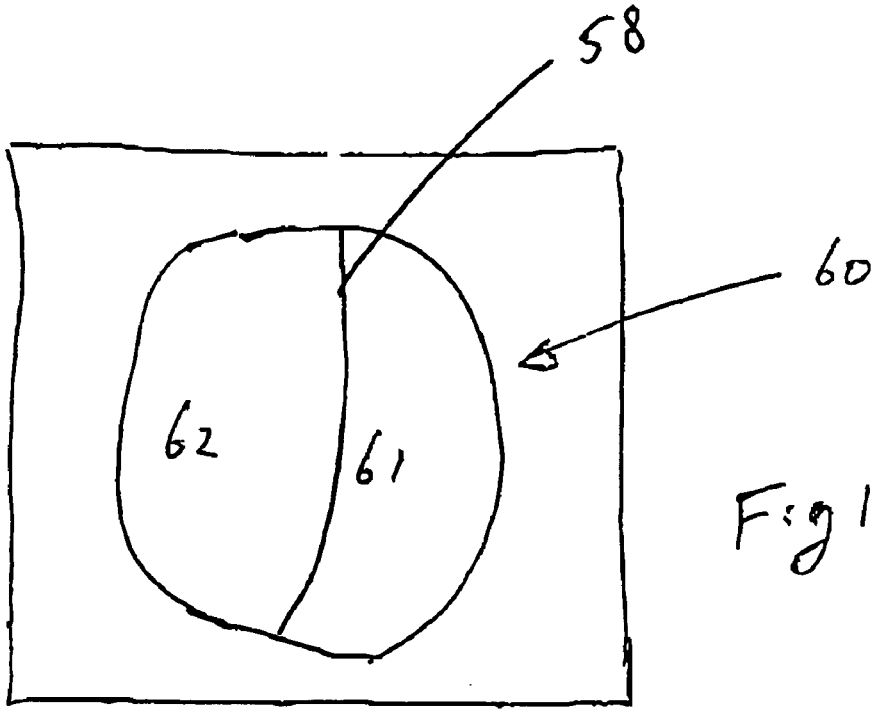

The introduction of the exterior covering ply 16 with the core assembly 10 firstly requires the pre-forming of the ply 16. The covering ply 16 may be framed by a holding frame 56 which holds the fabric ply 16 at or towards its perimeter in a taught condition (FIG. 15). The fabric material held in such a condition is then able to be placed within a molding device of FIG. 16 analogous to the molding device of FIG. 8. The molding device of FIG. 16 includes an upper mold 57 and a lower mold 58. The molding device of FIG. 16 provides a molded profile to the covering ply 16 of two cup shapes separated by a gully 58. With reference to FIGS. 17 and 17A, it can be seen that this gully 58 extends across the molded form 60 molded in the covering ply 16 by the molding device of FIG. 16. During the molding of the ply 16 by the molding device of FIG. 16, the upper mold is subjected to a temperature of approximately 185° C. and the lower mold to a temperature of approximately 185° C. and the dwell time for holding the mold in the closed condition thereby introducing the form to the exterior covering ply 16 is approximately 120 seconds. The path defined by the gully is substantially the same path as defined by the neckline disposed edge 15A of the cup form core assembly shown in FIG. 12. The profile of the gully 58 is of a three dimensional profile which follows a three dimensional profile substantially similar to the neck line disposed edge 15A of the cup form core assembly 10. That portion 61 of the cup molded in the exterior covering ply 16 disposed to one side of the gully 58 is substantially of the same shape as the cup form of the core assembly 10. Towards the other side of the gully 58 there is defined the other portion 62 of the shape molded in the exterior covering ply 16.

Figure 18:
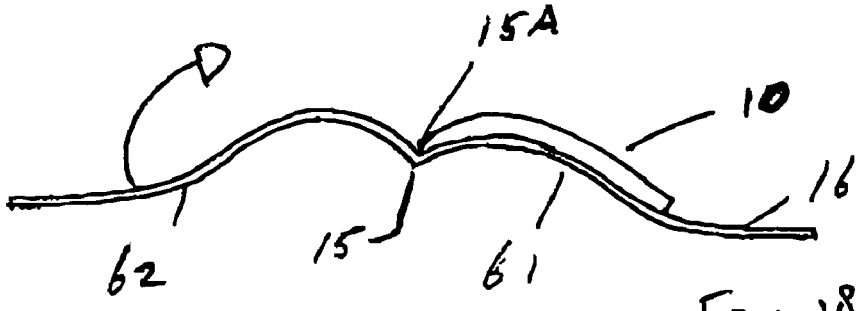
FIG. 18 is a sectional view through the molded covering ply of FIG. 17 and wherein the molded cup form core assembly of FIG. 12 has been engaged.
Figure 19:
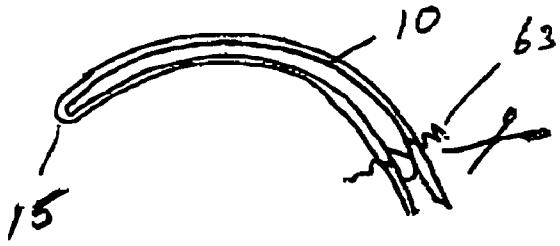
FIG. 19 is a sectional view of the assembly of FIG. 18 but wherein the portion of the fabric about the fold line has been folded to envelope the molded cup form core assembly of FIG. 12.

With reference to FIG. 18, the core assembly 10 with or without the provision of the reinforcing panel 30 is placed onto the region 61 of the molded form of the exterior covering ply 16 such that the neck line disposed edge 15A of the core assembly 10 is positioned along or at least parallel with the gully 58. Since both are of a matching profile, the edge 15A of the core assembly 10 can follow the gully 58. However in some configurations of the present invention and as for example shown in FIG. 22, the neck line disposed edge 15A of the core assembly 10 may not be positioned abutting the gully 58 and may be removed some distance therefrom. In any event, the gully 58 provides a fold line for the molded exterior covering ply 16 to be created, the fold line defining the neck line 15 of the finished form of the cup 2. With reference to FIG. 18 it can be seen how the other portion 62 of the molded ply 16 can be maneuvered to be folded about the fold line at the neck line 15 to thereby overlay the convex side of the core assembly 10 to a configuration as shown, for example, in FIG. 19.

During the affixing of the molded cup form core assembly 10 with the molded exterior covering ply 16, heat and pressure are reapplied to encourage the adhesive affixing of the core assembly with the molded exterior covering ply 16. In this step the molding temperature of both molds can be in the order of 185° C. and a dwell time pressure time of 30 seconds is used. The application of heat and pressure and with the use of adhesive would ensure a good laminated bond is established between the core assembly and the molded exterior covering ply.

In an alternative configuration, however not shown in the accompanying drawings, the core assembly 10 may be disposed to the concave side of the region 61 of the exterior covering ply 16. The shape of the molding regions of the molding device of FIG. 16 may in such a situation be slightly different in order to provide a crease at the region of the exterior covering ply 16 intermediate of regions 61 and 62 to define a crease in the exterior covering ply 16 for defining the fold of that material to provide the neckline to the cup assembly. In such an application of the core assembly 10, it may be that the fabric material 12 of the core assembly may be disposed to the concave side of the cup shaped core assembly 10 and the foam panel is disposed to the convex side in order to thereby have the foam ply 11 of the core assembly 10 engage against the convex side of the region 61 of the exterior covering ply 16. However such a positioning of the plies of the core assembly may not be essential as the fabric ply 12 disposed to the convex side of the cup form core assembly may lend itself to being adhesively and laminatingly affixed to the exterior covering ply 16 which is preferably also of a fabric material. However since the foam panel lends itself more readily for laminated attachment to a fabric panel, it is the preferred form of the invention that during the step of attaching the core assembly 10 to the exterior covering ply 16, that the interface of such engagement is between foam and fabric (foam ply 11 to fabric 16).

One part of the molded form of the exterior covering ply 16 as molded by the apparatus of FIG. 16 is of a larger size than that portion to other side of the gully 58. As can be seen with reference to FIG. 17, that portion 62 of the molded form of the molded exterior covering ply 16 is of a size larger than that portion 61. The smaller portion 61 is that portion to which the core assembly 10 is adhesively affixed to be laminated as a first step to the exterior covering ply 16. Since that portion 62 of the exterior covering ply 16 is to lie to the convex side of the core assembly it needs to be a larger size than that of the portion 61 disposed to the concave side of the core assembly. Furthermore, that portion disposed to the convex side, since it is more prone to shrinkage after washing requires for its size to be larger. Furthermore and in the preferred process during the application of the core assembly to the portion 61 of the molded exterior covering ply 16 as for example shown in FIG. 18, the core assembly 10 is to be held in situ and supported on a cooling mold during the adhesion process of the core assembly 10 with portion 61 of the molded exterior covering ply 16 cooling prior to the folding of portion 62 to the convex side of the core assembly, (for about 24 hours) will result in the shrinkage (due to the cooling of the material) of the portion 62 of the molded exterior covering ply 16.

The profile of the molding device of FIG. 16 may be generated by computer aided design in order to achieve a profile of the gully 58 of the covering ply 16 to match the profile of the neckline disposed edge 15A of the core assembly 10.

Once the covering fabric 16 has been folded, it can be sewn at the base of the cup 2 by a line of sewing 63 extending about the lower edge of the cup 2 so as to ensure that the free edges of the exterior covering ply 16 are captured with the core assembly and are presented so as not to fray. Any trimming may also occur once the sewing step has occurred or before trimming has occurred wherein the sewing step is for example of an overlooking kind to provide an appropriate finish to that portion of the perimeter of the cup assembly finished by such sewing. By such methods, the cup form as disclosed in any of the configurations as herein described or appreciated by those skilled in the art to fall within the scope of this invention can be formed.

The portion 62 of the exterior covering ply when folded need not necessarily become adhered to the exterior or convex side of the core assembly 10. Adhesion may occur but such is not essential and a slightly loose fitting or at least moveable to the core assembly convex side of the exterior covering ply may be provided.

Figure 23:
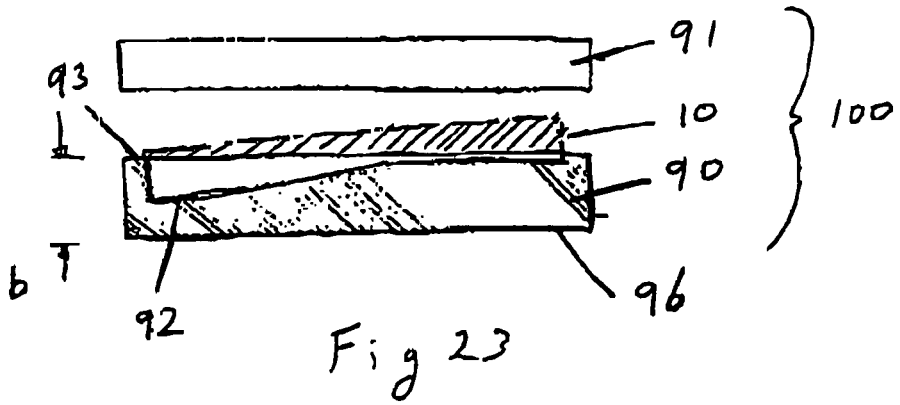
FIG. 23 shows an assembly where the foam panel is fitted into a recess of a lower mold and a top board prior to being placed on top of the foam panel to fix the foam panel in position for the cutting of a taper therein.

With reference to FIG. 23, there is shown in a sectional view a support structure 90 and a pressing board 91 intermediate of which there is positioned the foam pre-form core assembly 10. The support 90 includes a rebate 92 into which part of the pre-form core assembly 10 is located and supported. The rebate is of a shape so that at least a substantial part of the foam ply can be retracted within the support 90 below its upper surface 93. That portion of the core assembly 10 protruding beyond the upper surface 93 of the support 90 is at least in a substantial part if not all parts thereof removed to define the tapered finish to the ply of foam prior to it being subjected to the molding. Accordingly the shaded portion of the core assembly 10 is removed to thereby define the tapered region. The core assembly 10 is placed on the support 90 with the fabric ply facing the rebate side of the support 90.

Figure 25:
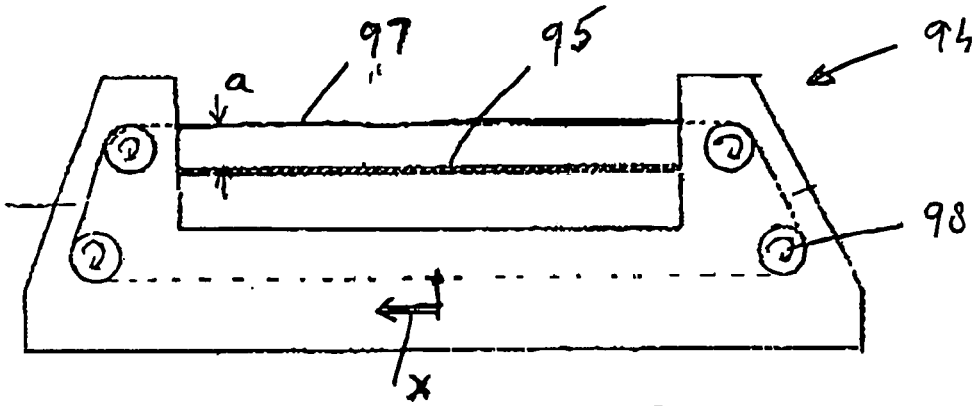
FIG. 25 is a view of a cutting station through which the units of FIG. 23 pass guided and delivered by the conveyor of FIG. 24 and for the purposes of removing the excess foam to define the desired profile of the foam ply of the core assembly.

With reference to FIG. 25 there is shown a cutting station 94. The cutting station 94 includes a support platform 95 to provide support to the support means 90 of the configuration of FIG. 23. The lower surface 96 of the support means 90 of FIG. 23 is placed onto the support platform 95. A cutter 97 which may for example be a saw is driven about a locus which includes the presentation of the cutter 97 for cutting the foam ply above the surface 93 of the support means 90 passing relative thereto. The cutter 97 is of an endless configuration and moves about a locus defined by idler wheels 98 or driven wheels 98 in for example direction X. The movement of the support means 97 and hence the foam ply of the core assembly 10 is in a direction and with reference to FIG. 25, either in or out of the page. The distance A between the support platform 95 and the cutter 97 presented for cutting the foam, is of a distance approximately the same as the distance B between the lower surface 96 and the upper surface 93 of the support means 90. Distance A may be slightly larger but not less than distance B.

Figure 24:
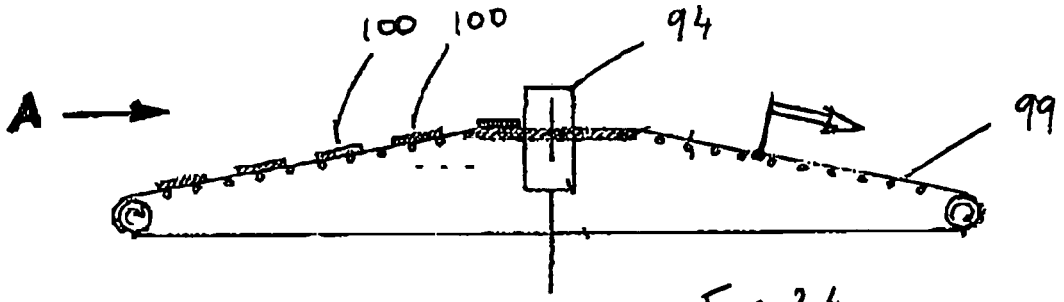
FIG. 24 shows a conveyor belt of a cutting machine the conveyor belt carrying a plurality of units of FIG. 3 for movement through a cutting station for the purposes of removing excess foam to define the taper in the foam ply of the core assembly.

With reference to FIG. 24, there is shown a semi-automated arrangement wherein a conveyor belt 99 is provided supporting a plurality of units 100 of FIG. 23. The conveyor 99 delivers the units 100 to the cutting station 94 for the presentation thereof to the cutter 97 for removing the foam. The panel 91 placed on top of the foam ply of the core assembly 10 provides a weighted member to press on top of the foam ply to provide some structure of rigidity to the foam during the cutting thereof. The weighted panel 91 ensures that the core assembly remains located in the appropriate position within the rebate 92 of the support means 90 during cutting.

The invention claimed is:

1. A breast cup construction of a cup shape to be incorporated as part of a brassiere, said breast cup construction comprising:

a molded to a cup shape laminated core assembly in a cup shape and having a convex side and a concave side, the core assembly comprising a ply of foam material in a cup shape and having a convex side, and a ply of fabric material disposed to the convex side of said ply of foam material;

an exterior ply overlying and disposed to the concave and the convex sides of at least part of said laminated core assembly, said exterior ply being folded at and to define at least part of a neckline perimeter of said cup shape.

2. A breast cup construction as claimed in claim 1 wherein said exterior ply is folded at and to define the entire neckline perimeter of said cup shape.

3. A breast cup construction as claimed in claim 1 wherein said ply of foam material and said ply of fabric material are coextensive.

4. A breast cup construction as claimed in claim 1 wherein said ply of foam material and said ply of fabric material are coextensive, and said ply of foam material being of a reduced thickness at the neckline perimeter.

5. A breast cup construction as claimed in claim 4, wherein gradual transition towards said reduced thickness of said ply of foam material toward the neckline perimeter.

6. A breast cup construction as claimed in claim 5 wherein said transition is a taper and such that said foam ply has a thinnest part at the neckline perimeter of said cup shape.

7. A breast cup construction as claimed in claim 5 wherein said transition is at a region of said foam ply extending from the neck line perimeter to less than one third a diametric width across said cup shape.

8. A breast cup construction as claimed in claim 1 wherein said ply of foam material and said ply of fabric material are coextensive except for at a region extending inwardly from the neckline perimeter of said laminated core assembly, where said laminated core assembly does not include said ply of foam material.

9. A breast cup construction as claimed in claim 8 wherein said region extending inwardly is less than one third the diametrical width of said cup shape.

10. A breast cup construction as claimed in claim 1 wherein said exterior ply is laminated to the concave side of said core assembly.

11. A breast cup construction as claimed in claim 1 wherein said exterior ply is laminated to the convex side of said core assembly.

12. A breast cup construction as claimed in claim 1 wherein said exterior ply is laminated to the concave side and the convex side of said core assembly.

13. A breast cup construction as claimed in claim 1 wherein said exterior ply is not sewn to said core assembly at said neckline perimeter.

14. A breast cup construction as claimed in claim 1 wherein said exterior ply is folded only about said core assembly at said neckline perimeter.

15. A breast cup construction as claimed in claim 1 wherein said cup shape has a base line perimeter away from said neckline perimeter; and said exterior ply is sewn to said core assembly at the base line perimeter of said cup shape.

16. A breast cup construction as claimed in claim 1 wherein said exterior ply is coextensive with said core assembly to said concave side thereof.

17. A breast cup construction as claimed in claim 1 wherein said exterior ply is coextensive with said core assembly to said convex side thereof.

18. A breast cup construction as claimed in claim 1 wherein said exterior ply is coextensive with said core assembly to said concave side and said convex side thereof.

19. A breast cup construction as claimed in claim 1 wherein said exterior ply is a fabric material.

20. A breast cup construction as claimed in claim 1 wherein said neckline is curved when viewed in a frontal direction.

21. A breast cup construction as claimed in claim 1 wherein a region of said cup shape is upwardly supportive, said core assembly includes a ply of reinforcing material that is disposed to the concave side of said core assembly and that is is provided at the upwardly supportive region of said cup shape.

22. A breast cup construction as claimed in claim 21 wherein said reinforcing material is a panel of fabric material.

23. A breast cup construction as claimed in claim 22 wherein said panel of fabric material is laminated to the concave side of said foam ply.

24. A breast cup construction as claimed in claim 23 wherein said panel of fabric material is laminated to said foam material.

25. A breast cup construction as claimed in claim 1 wherein said exterior ply is creased defining the fold thereof.

26. A breast cup of a cup shape to be incorporated as part of a brassiere, said breast cup comprising:

a molded to a cup shape laminated core assembly in a cup shape and having a convex side and a concave side, the core assembly comprising a ply of foam material and a ply of fabric material disposed to the concave side of said foam material;

an exterior ply overlying and disposed to the concave and convex sides of at least part of said laminated core assembly, said exterior ply folded at and to define a neckline perimeter of said cup shape.

27. A breast cup construction of a cup shape to be incorporated as part of a brassiere, said breast cup construction comprising:

a molded to a cup shape laminated core assembly in a cup shape and having a convex side and a concave side, the core assembly comprising a ply of foam material in a cup shape and having a convex side and a concave side and a ply of fabric material disposed to the convex side of said foam material, said cup shape also having a neckline side;

an exterior ply overlying and to the concave and convex sides of at least part of said laminated core assembly, said exterior ply enveloping the core assembly at at least those regions of said laminated core assembly disposed to the neckline side of said cup shape.

28. A method of forming a breast cup construction comprising (a) providing a molded to a cup shape laminated core assembly in a cup shape and having a convex side and a concave side, the core assembly comprising a ply of foam material in a cup shape and having a convex side and a ply of fabric material disposed to the convex side of said foam material and placing the core assembly onto a ply of fabric material which has molded therein two cup shaped reliefs which are juxtaposed and abut each other along a junction line, in a manner to position said core assembly onto one of said cup shaped reliefs and wherein the core assembly has a neckline perimeter; and positioning said core assembly adjacent said junction line, (b) affixing said core assembly with said ply of fabric material, (c) folding said ply of fabric material about said junction line to bring the other of said cup shape reliefs in overlying relation with said core assembly to the other side of said core assembly as affixed in step (b) and (d) affixing the second cup shaped relief with one or both of said core assembly and said first cups shaped reliefs.

29. A method as claimed in claim 28 wherein said neckline perimeter of said core assembly is positioned adjacent said junction line.

30. A method as claimed in claim 28 wherein said affixing the second cup shaped relief with one or both of said core assembly and said first cups shaped reliefs is by laminating.

31. A method as claimed in claim 28 wherein said affixing of said core assembly with said ply of fabric material comprising laminating them together.

32. A method as claimed in claim 28 wherein said cup shape laminated core assembly is formed from a preform panel laminated core assembly of a ply of foam material and a ply of fabric material.

33. A method as claimed in claim 32 wherein said ply of foam material is tapered towards an edge of said panel.

34. A method as claimed in claim 33 wherein said cup shape is molded into said preform by a molding press and said panel has a taper region, the positioning of the region of taper of said panel being placed relative to said molding press such that said cups shape is generated therein with said taper disposed toward the neckline perimeter of said cup shape.

* * * * *